US010586519B2

(12) United States Patent
Sumi et al.

(10) Patent No.: US 10,586,519 B2
(45) Date of Patent: Mar. 10, 2020

(54) CHORD ESTIMATION METHOD AND CHORD ESTIMATION APPARATUS

(71) Applicant: Yamaha Corporation, Hamamatsu-shi, Shizuoka-Ken (JP)

(72) Inventors: Kouhei Sumi, Hamamatsu (JP); Takuya Fujishima, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/270,979

(22) Filed: Feb. 8, 2019

(65) Prior Publication Data

US 2019/0251941 A1 Aug. 15, 2019

(30) Foreign Application Priority Data

Feb. 9, 2018 (JP) ..... 2018-022004
Nov. 29, 2018 (JP) ..... 2018-223837

(51) Int. Cl.
*G10H 1/38* (2006.01)
*G10H 1/00* (2006.01)

(52) U.S. Cl.
CPC ..... *G10H 1/383* (2013.01); *G10H 1/0008* (2013.01); *G10H 2210/066* (2013.01)

(58) Field of Classification Search
CPC . G10H 1/383; G10H 1/0008; G10H 2210/066
USPC ..... 84/609, 613, 637
See application file for complete search history.

(56) References Cited

U.S. PATENT DOCUMENTS 6,057,502 A 5/2000 Fujishima
7,705,231 B2 * 4/2010 Morris ..... G10H 1/0025 84/610
7,985,917 B2 * 7/2011 Morris ..... G10H 1/0025 84/610
8,676,123 B1 * 3/2014 Hinkle ..... H04M 1/274508 455/41.2
9,263,021 B2 * 2/2016 Savo ..... G06F 3/0481
9,269,339 B1 * 2/2016 Taube ..... G10H 1/00
9,286,901 B1 * 3/2016 Jimenez ..... H04M 1/274508
9,310,959 B2 * 4/2016 Serletic, II ..... G06F 3/0481
9,865,241 B2 * 1/2018 Colafrancesco ..... G10H 1/361
2004/0200335 A1 * 10/2004 Phillips ..... G10H 1/0008 84/483.2
2008/0209484 A1 * 8/2008 Xu ..... G10H 1/368 725/105
2008/0245215 A1 * 10/2008 Kobayashi ..... G10H 1/383 84/661
2009/0064851 A1 * 3/2009 Morris ..... G10H 1/0025 84/637
2010/0192755 A1 * 8/2010 Morris ..... G10H 1/0025 84/637
2010/0319517 A1 * 12/2010 Savo ..... G06F 3/0481 84/609

(Continued)

FOREIGN PATENT DOCUMENTS

JP 2000-298475 A 10/2000
JP 2008-209550 A 9/2008
JP 2017-215520 A 12/2018

*Primary Examiner* — David S Warren
(74) *Attorney, Agent, or Firm* — Crowell & Moring LLP

(57) ABSTRACT

A chord estimation apparatus estimates a first chord from an audio signal, and estimates a second chord by inputting the estimated first chord to a trained model that has learned a chord modification tendency.

16 Claims, 13 Drawing Sheets

(56) References Cited

U.S. PATENT DOCUMENTS

| | | | | |
|---|---|---|---|---|
| 2010/0322042 | A1* | 12/2010 | Serletic | G06F 3/0481 369/1 |
| 2012/0297958 | A1* | 11/2012 | Rassool | G06F 3/0481 84/609 |
| 2012/0297959 | A1* | 11/2012 | Serletic | G06F 3/0481 84/626 |
| 2013/0025437 | A1* | 1/2013 | Serletic | G10H 1/0025 84/634 |
| 2013/0220102 | A1* | 8/2013 | Savo | G06F 3/0481 84/609 |
| 2014/0053710 | A1* | 2/2014 | Serletic, II | G10H 7/00 84/609 |
| 2014/0053711 | A1* | 2/2014 | Serletic, II | G10H 1/38 84/611 |
| 2014/0140536 | A1* | 5/2014 | Serletic, II | G06F 3/0481 381/98 |
| 2014/0229831 | A1* | 8/2014 | Chordia | G06F 3/0482 715/717 |
| 2017/0110102 | A1* | 4/2017 | Colafrancesco | G10H 1/361 |
| 2017/0125057 | A1* | 5/2017 | Chordia | G06F 3/0482 |
| 2019/0005935 | A1* | 1/2019 | Sasai | G10L 25/54 |
| 2019/0266988 | A1* | 8/2019 | Sumi | G10H 1/383 |

* cited by examiner

CHORD ESTIMATION METHOD AND CHORD ESTIMATION APPARATUS

CROSS REFERENCE TO RELATED APPLICATIONS

This application is based on and claims priority from Japanese Patent Application No. 2018-22004, which was filed on Feb. 9, 2018, and Japanese Patent Application No. 2018-223837, which was filed on Nov. 29, 2018, the entire contents of each of which are incorporated herein by reference.

BACKGROUND

Technical Field

The present disclosure relates to a technique for recognizing a chord in music from an audio signal representing a sound such as a singing sound and/or a musical sound.

Description of the Relater Art

There has been conventionally proposed a technique for identifying a chord based on an audio signal representative of a sound such as a singing sound or a performance sound of a piece of music. For example, Japanese Patent Application Laid-Open Publication No. 2000-298475 (hereafter, JP 2000-298475) discloses a technique for recognizing chords based on a frequency spectrum analyzed based on sound waveform data of an input piece of music. Chords are identified by use of a pattern matching method, which involves comparing frequency spectrum information of chord patterns that are prepared in advance. Japanese Patent Application Laid-Open Publication No. 2008-209550 discloses a technique for identifying a chord that includes a note corresponding to a fundamental frequency, the peak of which is observed in a probability density function representative of fundamental frequencies in an input sound. Japanese Patent Application Laid-Open Publication No. 2017-215520 discloses a technique for identifying a chord by using a machine-trained neural network.

In the technique of JP 2000-298475, however, an appropriate chord pattern cannot be estimated accurately in a case where the information on the analyzed frequency spectrum differs greatly from the chord pattern prepared in advance.

SUMMARY

An object of the present disclosure is to estimate a chord with a high degree of accuracy.

In one aspect, a chord estimation method in accordance with some embodiments includes estimating a first chord from an audio signal, and inputting the first chord into a trained model that has learned a chord modification tendency, to estimate a second chord.

In another aspect, a chord estimation apparatus in accordance with some embodiments includes a processor configured to execute stored instructions to estimate a first chord from an audio signal, and estimate a second chord by inputting the estimated first chord to a trained model that has learned a chord modification tendency.

DESCRIPTION OF THE EMBODIMENTS

First Embodiment

Figure 1:
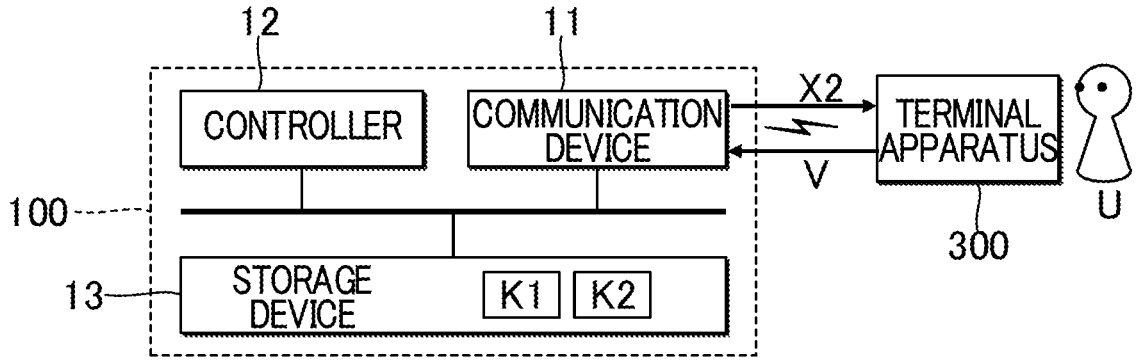
FIG. 1 is a block diagram illustrating a configuration of a chord estimation apparatus according to a first embodiment.

FIG. 1 is a block diagram illustrating a configuration of a chord estimation apparatus 100 according to a first embodiment. The chord estimation apparatus 100 is a computer system that estimates chords based on an audio signal V representative of vocal and/or non-vocal music sounds (for example, a singing sound, a musical sound, or the like) of a piece of music. In the first embodiment, a server apparatus is used as the chord estimation apparatus 100. The server apparatus estimates a time series of chords for an audio signal V received from a terminal apparatus 300 and transmits the estimated time series of chords to the terminal apparatus 300. The terminal apparatus 300 is, for example, a portable information terminal such as a mobile phone and a smartphone, or a portable or stationary information terminal such as a personal computer. The terminal apparatus 300 is capable of communicating with the chord estimation apparatus 100 via a mobile communication network or via a communication network including the Internet or the like.

Specifically, the chord estimation apparatus 100 includes a communication device 11, a controller 12, and a storage device 13. The communication device 11 is communication equipment that communicates with the terminal apparatus 300 via a communication network. The communication device 11 may employ either wired or wireless communication. The communication device 11 receives an audio signal V transmitted from the terminal apparatus 300. The controller 12 is, for example, a processing circuit such as a CPU (Central Processing Unit), and integrally controls components that form the chord estimation apparatus 100. The controller 12 includes at least one circuit. The controller 12 estimates a time series of chords based on the audio signal V transmitted from the terminal apparatus 300.

The storage device (memory) 13 is, for example, a known recording medium such as a magnetic recording medium or a semiconductor recording medium, or a combination of two or more types of recording media. The storage device 13 stores a program to be executed by the controller 12, and also various data to be used by the controller 12. In one embodiment, the storage device 13 may be, for example, a cloud storage provided separate from the chord estimation apparatus 100, which is used by the controller 12 to write or read data into or from the storage device 13 via a mobile communication network or via a communication network such as the Internet. Thus, the storage device 13 may be omitted from the chord estimation apparatus 100.

Figure 2:
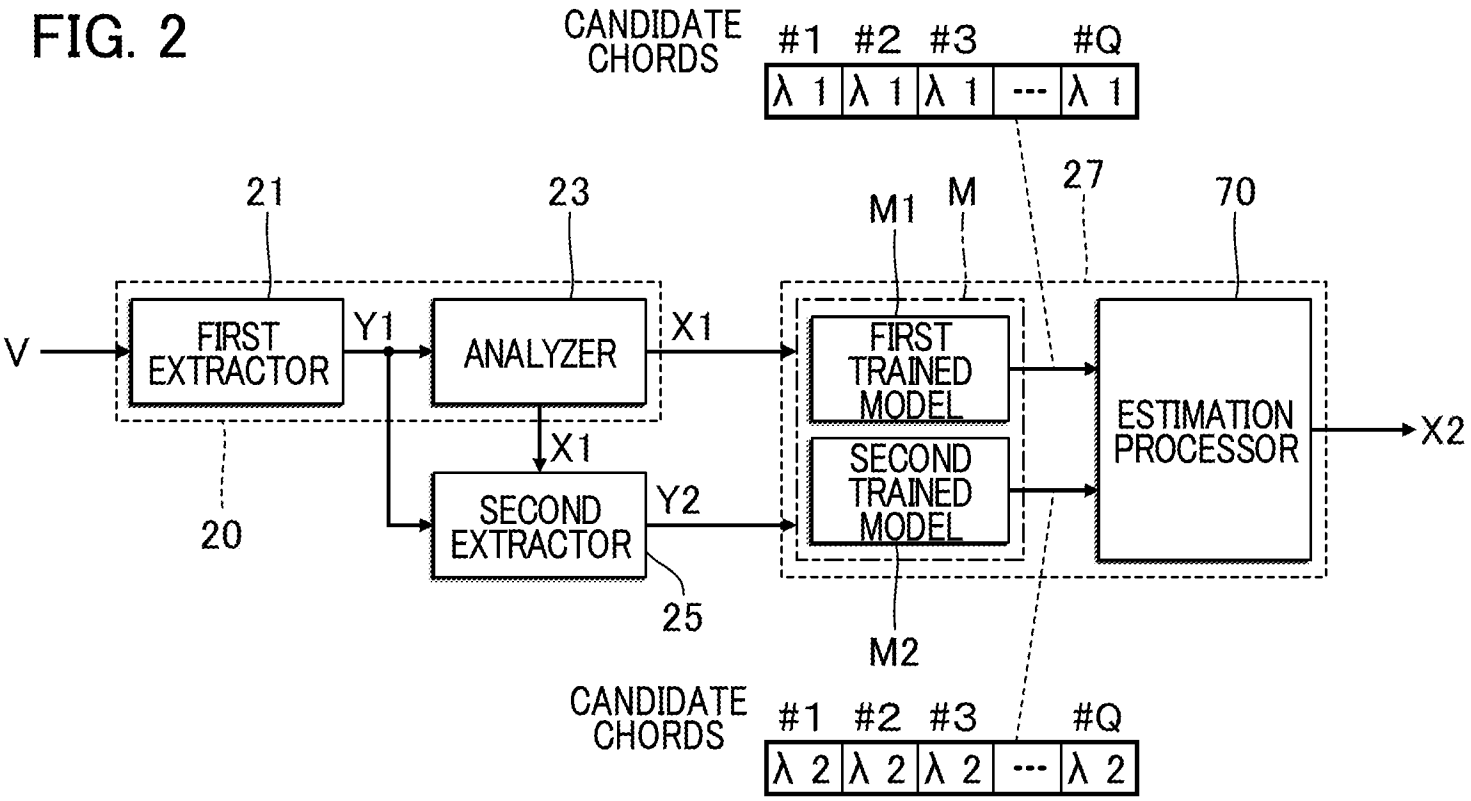
FIG. 2 is a block diagram illustrating a functional configuration of the chord estimation apparatus.

FIG. 2 is a block diagram illustrating a functional configuration of the controller 12. The controller 12 executes tasks according to the program stored in the storage device 13 to thereby implement functions (a first extractor 21, an analyzer 23, a second extractor 25, and a chord estimator 27) for estimating chords from the audio signal V. In one embodiment, the functions of the controller 12 may be implemented by a set of multiple devices (i.e., a system), or in another embodiment, part or all of the functions of the controller 12 may be implemented by a dedicated electronic circuit (for example, a signal processing circuit).

Figure 3:
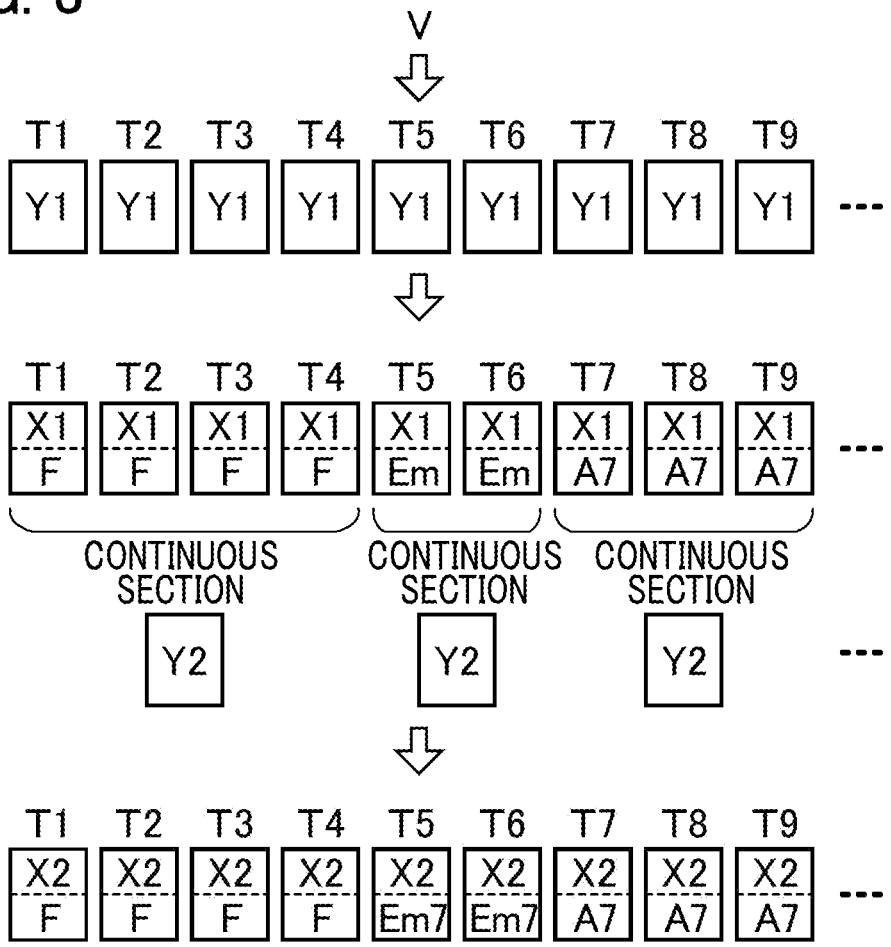
FIG. 3 is a schematic diagram illustrating pieces of data that are generated before second chords are estimated from an audio signal.

The first extractor 21 extracts from an audio signal V first feature amounts Y1 of the audio signal V. As shown in FIG. 3, a first feature amount Y1 is extracted for each unit period T (T1, T2, T3, . . . ). A unit period T is, for example, a period corresponding to one beat in a piece of music. That is, the first feature amounts Y1 are generated in time series from the audio signal V. In one embodiment, the unit period T of a fixed length or a variable length may be defined regardless of beat positions in a piece of music.

Figure 4:
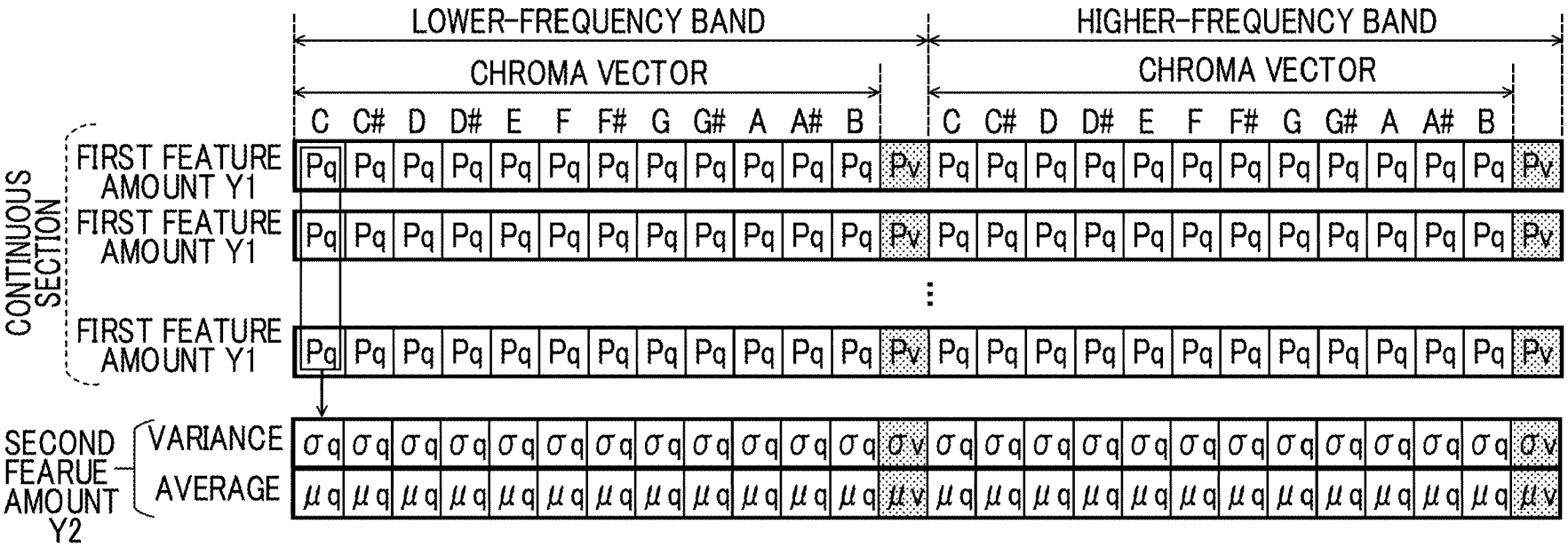
FIG. 4 is a schematic diagram illustrating first feature amounts and a second feature amount.

Each first feature amount Y1 is an indicator of a sound characteristic of a portion corresponding to each unit period T in the audio signal V. FIG. 4 schematically illustrates the first feature amount Y1. In an example, the first feature amount Y1 includes Chroma vectors (PCP: Pitch Class Profiles), each including an element that corresponds to each of pitch classes (for example, the twelve half tones of the 12 tone equal temperament scale). The first feature amount Y1 also includes intensities Pv of the audio signal V. A pitch class is a type of a pitch name that indicates the same pitch regardless of octave. An element corresponding to a pitch class in the Chroma vector is set to have an intensity (hereafter, a "component intensity") Pq that is obtained by adding up an intensity of a component corresponding to each pitch class in the audio signal V over multiple octaves. The first feature amount Y1 includes a Chroma vector and an intensity Pv for each of a lower-frequency band and a higher-frequency band relative to a predetermined frequency. The first feature amount Y1 includes a Chroma vector (including 12 elements corresponding to 12 pitch classes) for the lower-frequency band within an audio signal V and an intensity Pv of the audio signal V in the lower-frequency band, and a Chroma vector for the higher-frequency band within the audio signal V and an intensity Pv of the audio signal V in the higher-frequency band. Thus, each first feature amount Y1 is represented by a 26-dimensional vector as a whole.

The analyzer 23 estimates first chords X1 from the first feature amounts Y1 extracted by the first extractor 21. As shown in FIG. 3, a first chord X1 is estimated for each first feature amount Y1 (i.e., for each unit period T). That is, a time series of first chords X1 is generated. The first chord X1 is a preliminary or provisional chord for the audio signal V. For example, from among first feature amounts Y1 that are associated with respective different chords, a first feature amount Y1 that is most similar to the first feature amount Y1 extracted by the first extractor 21 is identified, and then a chord associated with the identified first feature amount Y1 is estimated as a first chord X1. In one embodiment, a statistical estimation model (for example, a Hidden Markov model or a neural network) that generates a first chord X1 by input of an audio signal V may be used for estimation of the first chords X1. As will be understood from the above description, the first extractor 21 and the analyzer 23 serve as a pre-processor 20 that estimates a first chord X1 from an audio signal V. The pre-processor 20 is an example of a "first chord estimator."

The second extractor 25 extracts second feature amounts Y2 from an audio signal V. A second feature amount Y2 is an indicator of a sound characteristic in which temporal changes in the audio signal V are taken into account. In one embodiment, the second extractor 25 extracts a second feature amount Y2 from the first feature amounts Y1 extracted by the first extractor 21 and the first chords X1 estimated by the analyzer 23. As shown in FIG. 3, the second extractor 25 extracts a second feature amount Y2 for each successive section (hereafter, a "continuous section") for which a same first chord X1 is estimated. A continuous section is, for example, a section corresponding to unit periods T1 to T4 for which a chord "F" is identified as a first chord X1. FIG. 4 schematically illustrates the second feature amount Y2. As shown in the figure, the second feature amount Y2 includes, for each of the lower-frequency band and the higher-frequency band, a pair of a variance $\sigma q$ and an average $\mu q$ for each time series of component intensities Pq corresponding to each pitch class and a pair of a variance $\sigma v$ and an average $\mu v$ for the time series of intensities Pv of the audio signal V. The second extractor 25 calculates, for each of the lower-frequency and higher-frequency bands, a pair of the variance $\sigma q$ and the average $\mu q$ for each of the pitch classes of the Chroma vector, and a pair of the variance $\sigma v$ and the average $\mu v$ of the intensities Pv. The variance $\sigma q$ is a variance of a time series of component intensities Pq for first feature amounts Y1 (each component intensity Pq is included in each first feature amount Y1) within the continuous section, and the average $\mu q$ of the same pair is an average of the same time series of component intensities Pq; the variance $\sigma v$ is a variance of a time series of intensities Pv for the first feature amounts Y1 (each intensity Pv is included in each first feature amount Y1) within the continuous section, and the average $\mu v$ of the same pair is an average of the same time series of intensities Pv. Thus, the second feature amount Y2 is represented by a 52-dimensional vector as a whole (a 26-dimensional vector for each of the variance and the average). As will be understood from the foregoing description, the second feature amount Y2 includes an index relating to temporal changes in component intensity Pq for each pitch class and an index relating to temporal changes in intensity Pv of an audio signal V. Such an index may indicate a degree of dispersion such as variance $\sigma q$, standard deviation, a difference between the maximum and minimum value, or the like.

A user U may need to or wish to modify a first chord X1 estimated by the pre-processor 20 in a case such as where the first chord X1 is erroneously estimated, or the first chord X1 is not one of preference for the user U. In such a case, the time series of the first chords X1 estimated by the preprocessor 20 may be transmitted to the terminal apparatus 300 such that the user U can modify the estimated chords, if necessary. Instead, the chord estimator 27 of the present embodiment uses a trained model M to estimate second chords X2 based on the first chords X1 and the second feature amounts Y2. As shown in FIG. 3, a time series of second chords X2 that each corresponds to respective ones of the first chords X1 is estimated. The trained model M is a predictive model that has learned a modification tendency of the first chords X1, and is generated by machine learning using a training data set of a large number of examples that show how the first chords X1 are modified by users. Thus, the second chord X2 is a chord that is statistically highly valid in view of a chord modification tendency made by a large number of users with respect to the first chord X1. The chord estimator 27 is an example of a "second chord estimator."

As shown in FIG. 2, the chord estimator 27 includes a trained model M and an estimation processor 70. The trained model M includes a first trained model M1 and a second trained model M2. The first trained model M1 is a predictive model that has learned a tendency of how the first chords X1 are modified (i.e., to what chords the first chords X1 are modified) by users (hereafter, a "first tendency"), where the tendency is based on learning data with respect to a large number of users. The second trained model M2 is a predictive model that has learned a chord modification tendency that is not the same as the first tendency (hereafter, a "second tendency"). Specifically, the second tendency is a tendency including a tendency of whether chords (e.g., first chords X1) are modified, and if modified, a tendency of how the chords are modified (i.e., to what chords the first chords X1 are modified). Thus, the second tendency constitutes a broad concept that encompasses the first tendency.

The first trained model M1 outputs an occurrence probability λ1 for each of chords serving as candidates for a second chord X2 (hereafter, "candidate chords") in response to an input of a first chord X1 and a second feature amount Y2. Specifically, the first trained model M1 outputs the occurrence probability X1 for each of Q (a natural number of two or more) candidate chords that differ in their combination of a root note, a type (for example, a chord type such as major or minor), and a bass note. The occurrence probability λ1 of a candidate chord with a high possibility of the first chord X1 being modified based on the first tendency will have a relatively high numerical value. The second trained model M2 outputs an occurrence probability λ2 for each of the Q candidate chords in response to an input of a first chord X1 and a second feature amount Y2. The occurrence probability λ2 of a candidate chord with a high possibility of the first chord X1 being modified based on the second tendency will have a relatively high numerical value. It is of note that "no chord" may be included as one of the Q candidate chords.

The estimation processor 70 estimates a second chord X2 based on a result of the estimation by the first trained model M1 and a result of the estimation by the second trained model M2. In the first embodiment, the second chord X2 is estimated based on the occurrence probability λ1 output by the first trained model M1 and the occurrence probability λ2 output by the second trained model M2. Specifically, the estimation processor 70 calculates an occurrence probability λ0 for each candidate chord by integrating the occurrence probability λ1 and the occurrence probability λ2 for each of the Q candidate chords, and identifies, as a second chord X2, a candidate chord with a high (typically, the highest) occurrence probability λ0 from among the Q candidate chords. That is, a candidate chord that is statistically valid with respect to the first chord X1 based on both the first tendency and the second tendency is output as a second chord X2. The occurrence probability λ0 of each candidate chord may be, for example, a weighted sum of the occurrence probability λ1 and the occurrence probability λ2. Alternatively, the occurrence probability λ0 may be calculated by adding the occurrence probability λ1 and the occurrence probability λ2 or by assigning the occurrence probability λ1 and the occurrence probability λ2 to a predetermined function. The time series of the second chords X2 estimated by the chord estimator 27 is transmitted to the terminal apparatus 300 of the user U.

Figure 5:
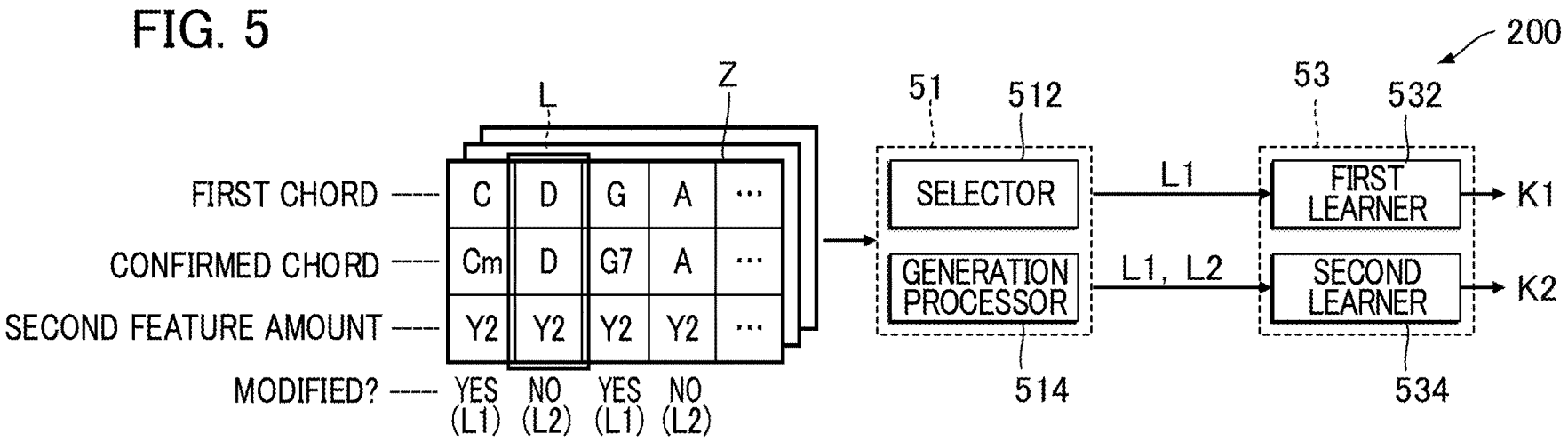
FIG. 5 is a block diagram illustrating a functional configuration of a machine learning apparatus.

The first trained model M1 is, for example, a neural network (typically, a deep neural network), and is defined by multiple coefficients K1. Similarly, the second trained model M2 is, for example, a neural network (typically, a deep neural network), and is defined by multiple coefficients K2. The coefficients K1 and the coefficients K2 are set by machine learning using training data L indicating a chord modification tendency with respect to a large number of users. FIG. 5 is a block diagram illustrating a configuration of a machine learning apparatus 200 for setting the coefficients K1 and the coefficients K2. The machine learning apparatus 200 is implemented by a computer system including a training data generator 51 and a learner 53. The training data generator 51 and the learner 53 are realized by a controller (not shown) such as a CPU (Central Processing Unit). In one embodiment, the machine learning apparatus 200 may be mounted to the chord estimation apparatus 100.

A storage device (not shown) of the machine learning apparatus 200 stores multiple pieces of modification data Z for generating the training data L. The modification data Z are collected in advance from a large number of terminal apparatuses. A case is assumed in which the analyzer 23 at the terminal apparatus of a user has estimated a time series of first chords X1 based on an audio signal V. The user confirms whether or not a modification is to be made for each of the first chords X1 estimated by the analyzer 23, and when the first chord X1 is to be modified, the user inputs a new chord. Thus, each piece of modification data Z shows a history of modifications of the first chords X1 made by the user. When the user has confirmed the first chords X1, a piece of the modification data Z is generated and transmitted to the machine learning apparatus 200. Each piece of modification data Z is transmitted from the terminal apparatuses of a large number of users to the machine learning apparatus 200. In one embodiment, the machine learning apparatus 200 may generate the modification data Z.

Each piece of modification data Z represents whether the first chords X1 are modified by the user and how the first chords X1 are modified for each time series of first chords X1 estimated from an audio signal V. Specifically, as shown in FIG. 5, a piece of modification data Z is a data table in which each estimated first chord X1 in the terminal apparatus is recorded in association with a confirmed chord and a second feature amount Y2 that correspond to the estimated first chord X. That is, the modification data Z includes a time series of first chords X1, a time series of confirmed chords, and a time series of second feature amounts Y2. The confirmed chord is a chord that represents whether the first chord X1 is modified and what the first chord X1 is modified to. Specifically, when the user modifies the first chord X1 to a new chord, the new chord is set as a confirmed chord, and when the user does not modify the first chord X1, the first chord X1 is set as a confirmed chord. The second feature amount Y2 corresponding to the first chord X1 is generated based on the first chord X1 and the first feature amount Y1, and is recorded in the modification data Z.

The training data generator 51 of the machine learning apparatus 200 generates training data L based on the modification data Z. As shown in FIG. 5, the training data generator 51 of the first embodiment includes a selector 512 and a generation processor 514. The selector 512 selects modification data Z suitable for generating the training data L from among the multiple pieces of modification data Z. For example, the modification data Z, which includes a greater number of instances of modification of the first chords X1, can be considered to be highly reliable as data representing the user's tendency for changing the chords. Accordingly, the modification data Z in which the number of modifications of the first chords X1 exceeds a predetermined threshold is selected, for example. Specifically, from among multiple pieces of modification data Z, modification data Z is selected if it has, for example, 10 or more confirmed chords that are different from the corresponding first chords X1.

The generation processor 514 generates training data L based on the modification data Z selected by the selector 512. The training data L is made up of a combination of a first chord X1, a confirmed chord corresponding to the first chord X1, and a second feature amount Y2 corresponding to the first chord X1. Multiple pieces of training data L are generated from a single piece of modification data Z selected by the selector 512. The training data generator 51 generates N pieces of training data L by the above-described processes.

The N pieces of training data L are divided into N1 pieces of training data L and N2 pieces of training data L (N=N1+N2). The N1 pieces of training data L (hereafter, "modified training data L1") each include a first chord X1 modified by the user. The confirmed chord included in each of the N1 pieces of modified training data L1 is a new chord to which the corresponding first chord X1 is modified (i.e., a chord different from the corresponding first chord X1). The N1 pieces of modified training data L1 are a big data set, used for learning, and representative of the first tendency. In contrast, the N2 pieces of training data L (hereafter, "unmodified training data L2") each include a first chord X1 that was not modified by the user. The confirmed chord included in each of the N2 pieces of unmodified training data L2 is a chord that is the same as the corresponding first chord X1. The N pieces of training data L including the N1 pieces of modified training data L1 and the N2 pieces of unmodified training data L2 together form a big data set, for learning, representative of the second tendency.

The learner 53 generates coefficients K1 and coefficients K2 based on the N pieces of training data L generated by the training data generator 51. The learner 53 includes a first learner 532 and a second learner 534. The first learner 532 generates multiple coefficients K1 that define the first trained model M1 by machine learning (deep learning) using the N1 pieces of modified training data L1 out of the N pieces of training data L. Thus, the first learner 532 generates coefficients K1 that reflect the first tendency. The first trained model M1 defined by the coefficients K1 is a predictive model that has learned relationships between first chords X1 and second feature amounts Y2, and the confirmed chord (the second chord X2) based on the tendency represented by the N1 pieces of modified training data L1.

The second learner 534 generates multiple coefficients K2 that define the second trained model M2 by machine learning using the N pieces of training data (the N1 pieces of modified training data L1 and the N2 pieces of unmodified training data L2). Thus, the second learner 534 generates coefficients K2 that reflect the second tendency. The second trained model M2 defined by the coefficients K2 is a predictive model that has learned relationships between first chords X1 and second feature amounts Y2, and confirmed chords based on the tendency represented by the N pieces of training data L. The coefficients K1 and the coefficients K2 generated by the machine learning apparatus 200 are stored in the storage device 13 of the chord estimation apparatus 100.

Figure 6:
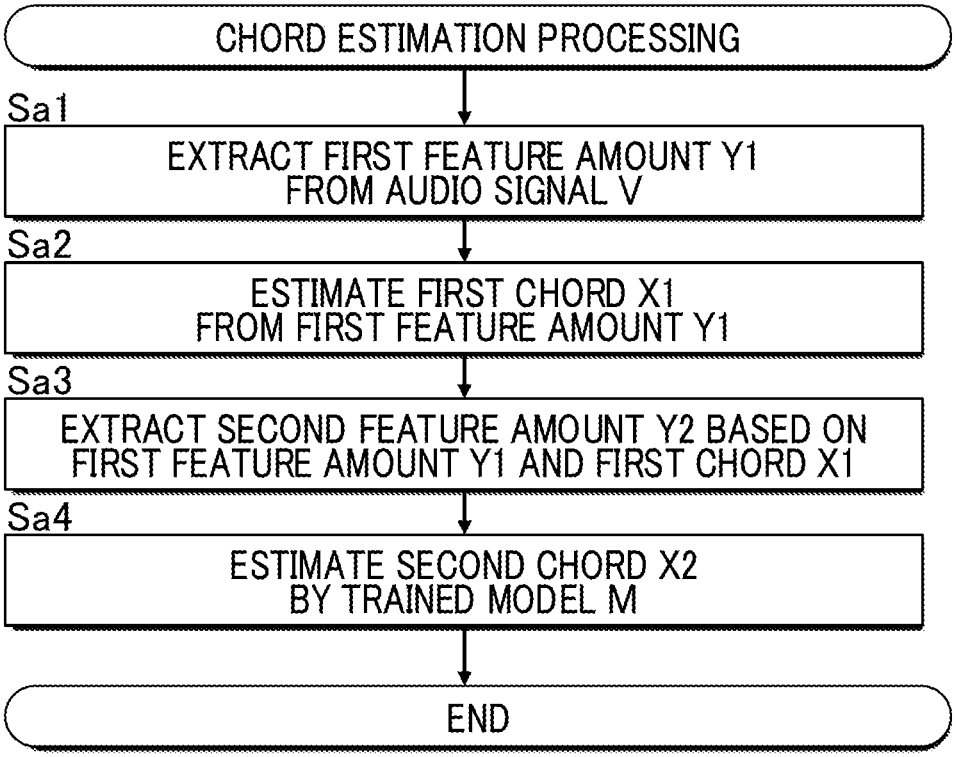
FIG. 6 is a flowchart illustrating chord estimation processing.

FIG. 6 is a flowchart illustrating processing for estimating second chords X2 (hereafter, "chord estimation processing"). This processing is performed by the controller 12 of the chord estimation apparatus 100. The chord estimation processing is started upon receiving an audio signal V transmitted from the terminal apparatus 300, for example. Upon start of the chord estimation processing, the first extractor 21 extracts first feature amounts Y1 from the audio signal V (Sa1). The analyzer 23 estimates first chords X1 based on the first feature amounts Y1 extracted by the first extractor 21 (Sa2). The second extractor 25 extracts second feature amounts Y2 based on the first feature amounts Y1 extracted by the first extractor 21 for each continuous section identified from the first chords X1 estimated by the analyzer 23 (Sa3). The chord estimator 27 estimates a second chord X2 by inputting the first chord X1 and the second feature amount Y2 to the trained model M (Sa4).

Figure 7:
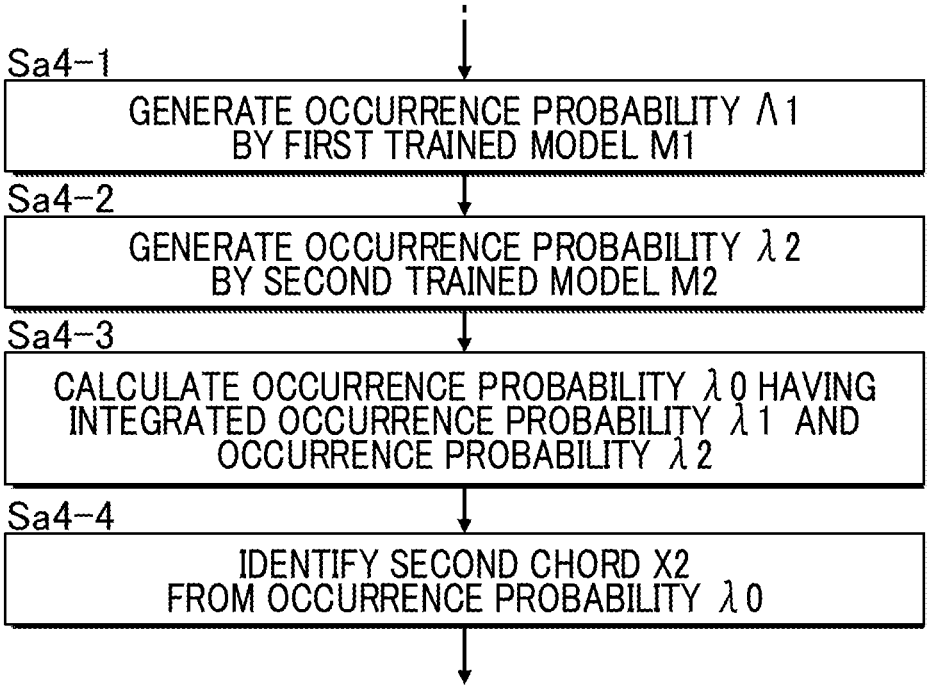
FIG. 7 is a flowchart illustrating a process of estimating second chords.

FIG. 7 is a detailed flowchart illustrating a process (Sa4) of the chord estimator 27. The chord estimator 27 executes the first trained model M1 that has learned the first tendency, to generate an occurrence probability λ1 for each candidate chord (Sa4-1). The chord estimator 27 executes the second trained model M2 that has learned the second tendency, thereby to generate an occurrence probability λ2 for each candidate chord (Sa4-2). The generation of the occurrence probability λ1 (Sa4-1) and the generation of the occurrence probability λ2 (Sa4-2) may be performed in reverse order. The chord estimator 27 integrates the occurrence probability λ1 generated by the first trained model M1 and the occurrence probability λ2 generated by the second trained model M2 for each candidate chord to calculate an occurrence probability λ0 for each candidate chord (Sa4-3). The chord estimator 27 estimates, as the second chord X2, a candidate chord that has a high occurrence probability λ0 among the Q candidate chords (Sa4-4).

As will be understood from the above description, in the first embodiment, second chords X2 are estimated by inputting first chords X1 and second feature amounts Y2 to the trained model M that has learned the chord modification tendency, and therefore, the second chords X2 in which the chord modification tendency is taken into account can be estimated more accurately as compared with a configuration in which only the first chords X1 are estimated from the audio signal V.

In the first embodiment, the second chords X2 are estimated based on a result of the estimation (the occurrence probability λ1) by the first trained model M1 that has learned the first tendency, and a result of the estimation (the occurrence probability λ2) by the second trained model M2 that has learned the second tendency. In contrast, estimating second chords X2 that appropriately reflect the chord modification tendency would not be possible if the estimation relied on only one of the result of estimation by the first trained model M1 or the result of the estimation by the second trained model M2. If only the result of the estimation by the first trained model M1 is used, the input first chords X1 inevitably will be modified; whereas if only the result of the estimation by the second trained model M2 is used, the first chords X1 are less likely to be modified. According to a configuration of the first embodiment in which second chords X2 are estimated using the first trained model M1 and the second trained model M2, the second chords X2 that more appropriately reflect the chord modification tendency can be estimated. This is in contrast to estimating the second chords X2 using one only of the first trained model M1 or the second trained model M2.

In the first embodiment, second chords X2 are estimated by inputting, to the trained model M, second feature amounts Y2 each including the variances $\sigma q$ and the averages $\mu q$ of respective time series of component intensities Pq and the variances $\sigma v$ and the averages $\mu v$ of the respective time series of intensities Pv of the audio signal V. Therefore, the second chords X2 can be estimated with a high degree of accuracy with temporal changes in the audio signal V being taken into account.

Second Embodiment

A second embodiment will now be described below. In each of the modes described below as examples, the same reference signs are used for identifying elements of which functions or actions are similar to those in the first embodiment, and detailed descriptions thereof are omitted, as appropriate. In the first embodiment, second chords X2 are estimated by inputting first chords X1 and second feature amounts Y2 to the trained model M, but in the second embodiment, data to be input to the trained model M will be modified, as in each of the example modes described below.

Figure 8:
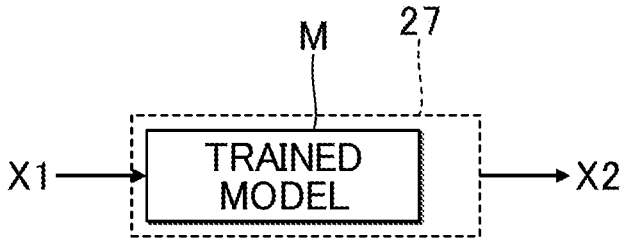
FIG. 8 is a block diagram illustrating a chord estimator according to a second embodiment.

FIG. 8 is a block diagram illustrating a chord estimator 27 of the second embodiment. In the second embodiment, second chords X2 are estimated by inputting first chords X1 to a trained model M. The trained model M of the second embodiment is a predictive model that has learned a relationship between first chords X1 and second chords X2 (confirmed chord). The first chords X1 to be input to the trained model M are generated in the same manner as in the first embodiment. In the second embodiment, no extraction of the second feature amounts Y2 is performed (the second extractor 25 of the first embodiment is omitted).

Third Embodiment

Figure 9:
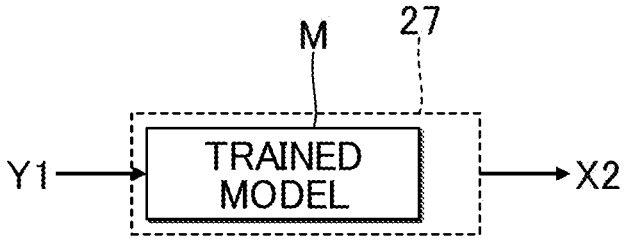
FIG. 9 is a block diagram illustrating a chord estimator according to a third embodiment.

FIG. 9 is a block diagram illustrating a chord estimator 27 in a third embodiment. In the third embodiment, second chords X2 are estimated by inputting first feature amounts Y1 to a trained model M. The trained model M of the third embodiment is a predictive model that has learned relationships between first feature amounts Y1 and second chords X2 (confirmed chord). The first feature amounts Y1 to be input to the trained model M are generated in the same manner as in the first embodiment. In the third embodiment, neither estimation of the first chords X1 nor extraction of the second feature amounts Y2 are performed. Thus, the analyzer 23 and the second extractor 25 of the first embodiment are omitted. In this configuration, the first feature amounts Y1 are input to the trained model M, and thus the chord modification tendencies of users are taken into consideration. Therefore, the second chords X2 can be identified with a higher degree of accuracy compared to a configuration in which the pre-processor 20 is used.

Fourth Embodiment

Figure 10:
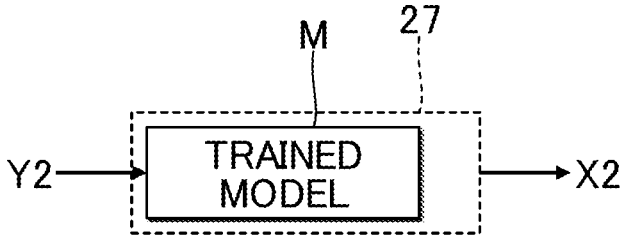
FIG. 10 is a block diagram illustrating a chord estimator according to a fourth embodiment.

FIG. 10 is a block diagram illustrating a chord estimator 27 in a fourth embodiment. In the fourth embodiment, second chords X2 are estimated by inputting second feature amounts Y2 to a trained model M. The trained model M of the fourth embodiment is a predictive model that has learned relationships between second feature amounts Y2 and second chords X2 (confirmed chord). The second feature amounts Y2 to be input to the trained model M are generated in the same manner as in the first embodiment.

As will be understood from the foregoing description, the data to be input to the trained model M for estimating second chords X2 from an audio signal V are generally represented as an indicator of a sound characteristic of the audio signal V (hereafter, a "feature amount of the audio signal V"). Examples of the feature amount of the audio signal V include any one of the first feature amount Y1, the second feature amount Y2, and the first chord X1, or a combination of any two or all of them. It is of note that the feature amount of the audio signal V is not limited to the first feature amount Y1, the second feature amount Y2, or the first chord X1. For example, the frequency spectrum may be used as the feature amount of the audio signal V. The feature amount of the audio signal V may be any feature amount in which a difference in a chord is reflected.

As will be understood from the above description, the trained model M is generally represented as a statistical estimation model that has learned relationships between feature amounts of audio signals V and the chords. According to the configuration of each embodiment described above in which second chords X2 are estimated from an audio signal V by inputting the feature amount of the audio signal V to the trained model M, the chords are estimated in accordance with the tendency learned by the trained model M. As compared with a configuration in which the chords are estimated by comparing chords prepared in advance and the feature amount of the audio signal V (for example, a frequency spectrum as disclosed in JP 2000-298475), the chords can be estimated with a higher degree of accuracy based on various feature amounts of audio signals V. To be more specific, in the technique disclosed in JP 2000-298475, appropriate chords cannot be estimated accurately when the feature amount of the audio signal V greatly differs from the chords prepared in advance. In contrast, according to the configuration of each embodiment described above, the chords are estimated in accordance with the tendency learned by the trained model M, and therefore, appropriate chords can be estimated with a high degree of accuracy regardless of the content of the feature amount of the audio signal V.

Among the trained models M that have learned a relationship between the feature amounts of audio signals V and chords, the trained model M to which the first chords are input, as described in the first and second embodiments, is generally represented as a trained model M that has learned modifications of chords.

Fifth Embodiment

Figure 11:
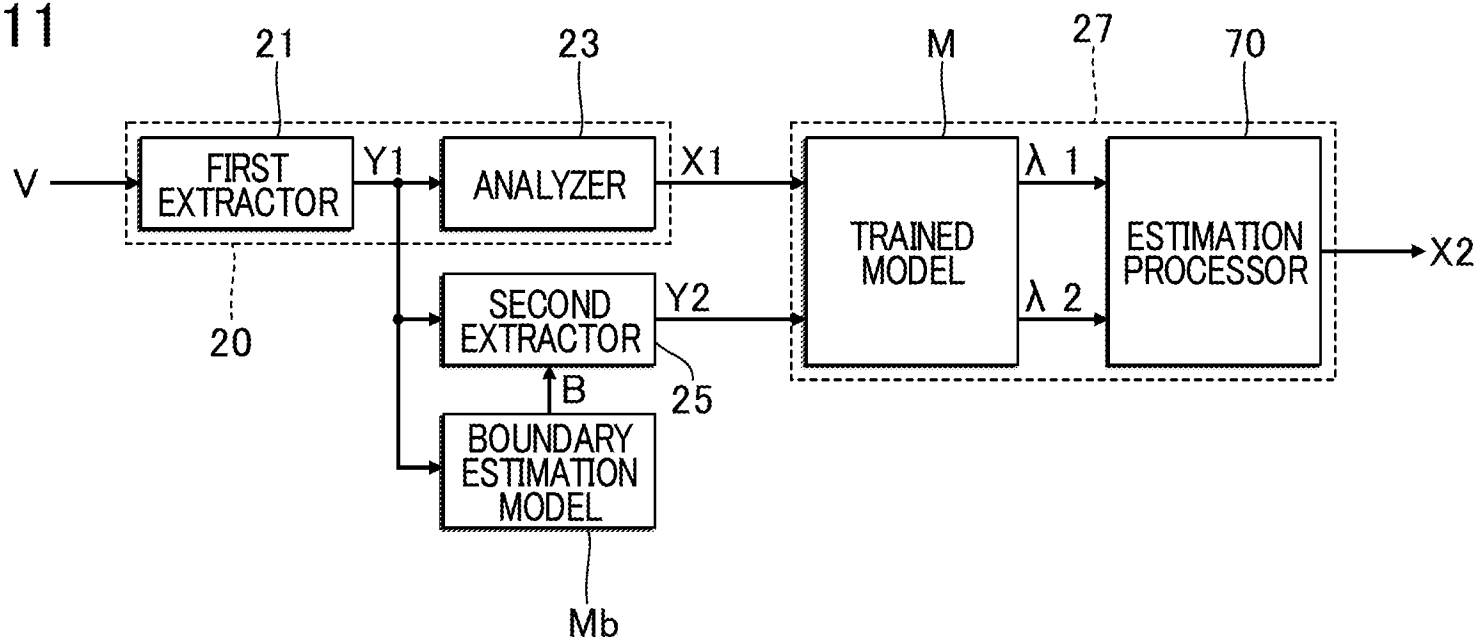
FIG. 11 is a block diagram illustrating a functional configuration of a chord estimation apparatus according to a fifth embodiment.

FIG. 11 is a block diagram illustrating a functional configuration of a controller 12 in a chord estimation apparatus 100 of a fifth embodiment. The controller 12 of the fifth embodiment serves as a boundary estimation model Mb in addition to components (a pre-processor 20, a second extractor 25, and a chord estimator 27) that are substantially the same as those in the first embodiment. A time series of first feature amounts Y1 generated by the first extractor 21 is input to the boundary estimation model Mb. The boundary estimation model Mb is a trained model that has learned relationships between time series of first feature amounts Y1 and pieces of boundary data B. Accordingly, the boundary estimation model Mb outputs boundary data B based on the time series of the first feature amounts Y1. The boundary data B contains time series data representative of boundaries between continuous sections on a time axis. A continuous section is a successive section during which a same chord is present in the audio signal V. For example, a recurrent neural network (RNN) such as a long short term memory (LSTM) suitable for processing the time series data is preferable for use as the boundary estimation model Mb.

Figure 12:
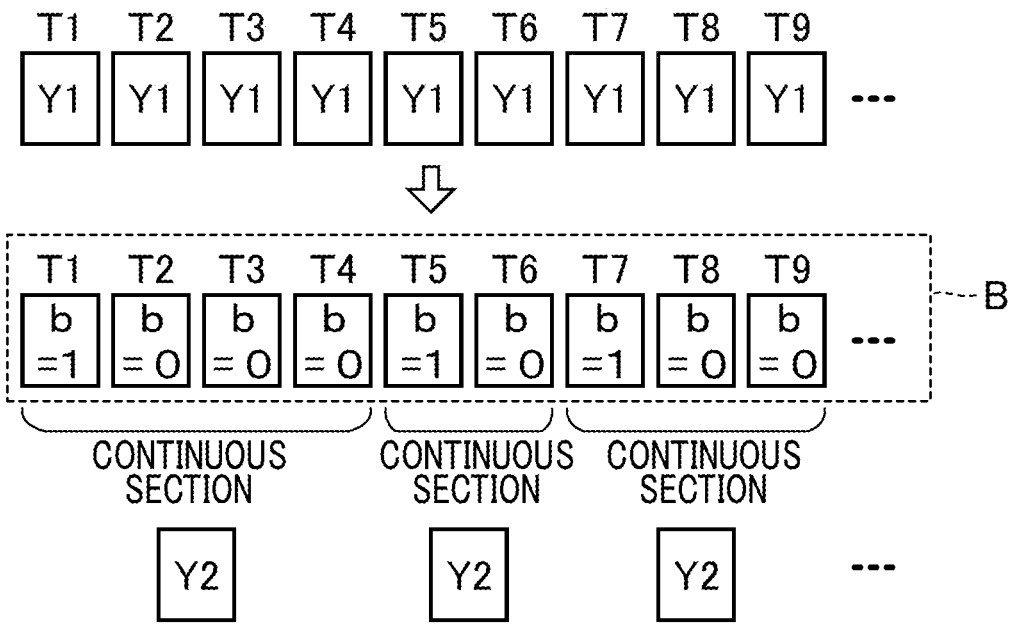
FIG. 12 is an explanatory diagram illustrating boundary data.

FIG. 12 is an explanatory diagram illustrating the boundary data B. The boundary data B includes a time series of data segments b, each data segment b corresponding to each unit period T on the time axis. A single data segment b is output from the boundary estimation model Mb for every first feature amount Y1 of each unit period T. A data segment b corresponding to each unit period T is a piece of data that represents in binary form whether a time point corresponding to the unit period T corresponds to a boundary between two consecutive continuous sections. For example, a data segment b is set to have a numerical value 1 when the start of the unit period T is a boundary between the continuous sections, and is set to have a numerical value 0 when the start of the unit period T does not correspond to the boundary between the continuous sections. That is, the numerical value 1 taken by the data segment b indicates that the unit period T which corresponds to the data segment b also corresponds to the start of the continuous section. As will be understood from the above description, the boundary estimation model Mb is a statistical estimation model that estimates boundaries between continuous sections based on a time series of first feature amounts Y1. The boundary data B consists of time-series data that represent in binary form whether each of multiple time points on the time axis corresponds to a boundary between consecutive continuous sections.

The boundary estimation model Mb is implemented by a combination of a program that causes the controller 12 to execute a calculation to generate boundary data B from a time series of first feature amounts Y1 (for example, a program module that constitutes a part of artificial intelligence software) and multiple coefficients Kb for application to the calculation. The coefficients Kb are set by machine learning (in particular, deep learning) by using multiple pieces of training data Lb, and are stored in the storage device 13.

The second extractor 25 of the first embodiment extracts a second feature amount Y2 for each of continuous sections, where each continuous section is defined as a section during which the first chord X1 analyzed by the analyzer 23 remains the same. In contrast, the second extractor 25 of the fifth embodiment extracts a second feature amount Y2 for each of continuous sections defined in accordance with the boundary data B output from the boundary estimation model Mb. Specifically, the second extractor 25 generates a second feature amount Y2 based on one or more first feature amounts Y1 in each of the continuous sections defined by the boundary data B. Accordingly, no input of the first chords X1 to the second extractor 25 is performed. The contents of the second feature amount Y2 are substantially the same as those in the first embodiment.

Figure 13:
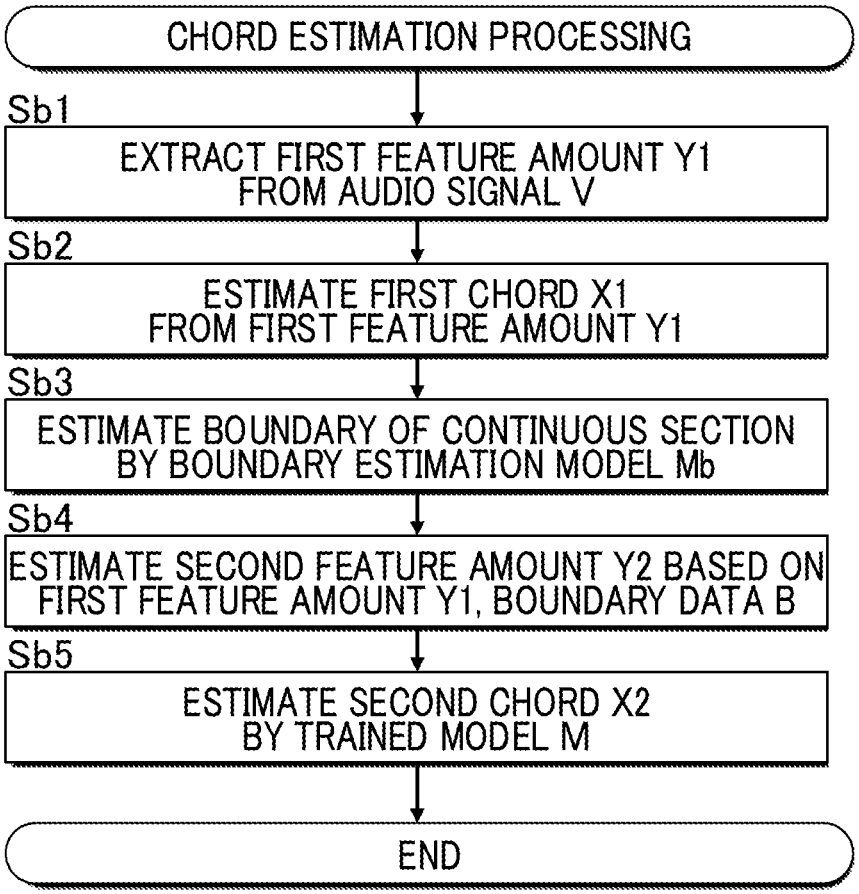
FIG. 13 is a flowchart illustrating chord estimation processing in the fifth embodiment.

FIG. 13 is a flowchart illustrating a specific procedure of chord estimation processing in the fifth embodiment. Upon start of the chord estimation processing, the first extractor 21 extracts a first feature amount Y1 for each unit period T from an audio signal V (Sb1). The analyzer 23 estimates a first chord X1 for each unit period T based on the first feature amount Y1 extracted by the first extractor 21 (Sb2).

The boundary estimation model Mb generates boundary data B based on a time series of first feature amounts Y1 extracted by the first extractor 21 (Sb3). The second extractor 25 extracts a second feature amount Y2 based on the first feature amounts Y1 extracted by the first extractor 21 and the boundary data B generated by the boundary estimation model Mb (Sb4). Specifically, the second extractor 25 generates the second feature amount Y2 based on one or more first feature amounts Y1 in each of continuous sections identified based on the boundary data B. The chord estimator 27 estimates second chords X2 by inputting the first chords X1 and the second feature amounts Y2 to the trained model M (Sb5). The specific procedure of estimating the second chords X2 (Sb5) is substantially the same as that described in the first embodiment (FIG. 7). The estimation of the first chords X1 by the analyzer 23 (Sb2) and the estimation of the boundary data B by the boundary estimation model Mb (Sb3) may be performed in reverse order.

Figure 14:
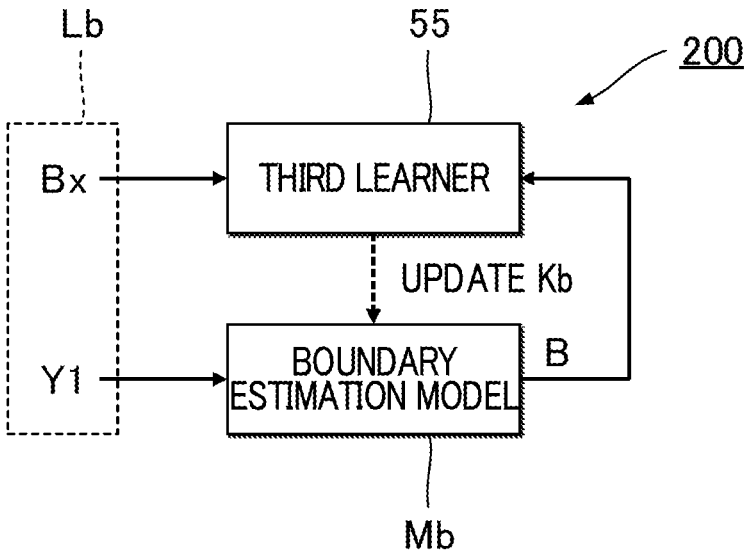
FIG. 14 is an explanatory diagram illustrating machine learning of a boundary estimation model in the fifth embodiment.

FIG. 14 is a block diagram illustrating a configuration of a machine learning apparatus 200 for setting coefficients Kb of the boundary estimation model Mb. The machine learning apparatus 200 of the fifth embodiment includes a third learner 55. The third learner 55 sets coefficients Kb by machine learning using multiple pieces of training data Lb. As shown in FIG. 14, each piece of training data Lb includes a time series of first feature amounts Y1 and boundary data Bx. The boundary data Bx consists of a time series of known data segments b (i.e., correct answer values), each of which corresponds to each first feature amount Y1. From among the data segments b in the boundary data Bx, a data segment b that corresponds to a unit period T positioned at the beginning of each continuous section (a first unit period T) takes a numerical value 1, and a data segment b that corresponds to any one of the unit periods T other than the first unit period T within each continuous section takes a numerical value 0.

The third learner 55 updates the coefficients Kb of the boundary estimation model Mb so as to reduce the difference between boundary data B that is output from a provisional boundary estimation model Mb in response to an input of a time series of first feature amounts Y1 of the training data Lb, and the boundary data Bx in the training data Lb. Specifically, the third learner 55 iteratively updates the coefficients Kb by, for example, back propagation to minimize an evaluation function representative of the difference between the boundary data B and the boundary data Bx. The coefficients Kb set by the machine learning apparatus 200 in the above procedure are stored in the storage device 13 of the chord estimation apparatus 100. Accordingly, the boundary estimation model Mb outputs statistically valid boundary data B with respect to an unknown time series of first feature amounts Y1 based on the tendency that is latent in relationships between time series of the first feature amounts Y1 and pieces of boundary data Bx in the pieces of training data Lb. The third learner 55 may be mounted to the chord estimation apparatus 100.

As described above, according to the fifth embodiment, the boundary data B concerning an unknown audio signal V is generated using the boundary estimation model Mb that has learned relationships between time series of the first feature amounts Y1 and pieces of boundary data B. Accordingly, the second chords X2 can be estimated highly accurately by using second feature amounts Y2 generated based on the boundary data B.

Sixth Embodiment

Figure 15:
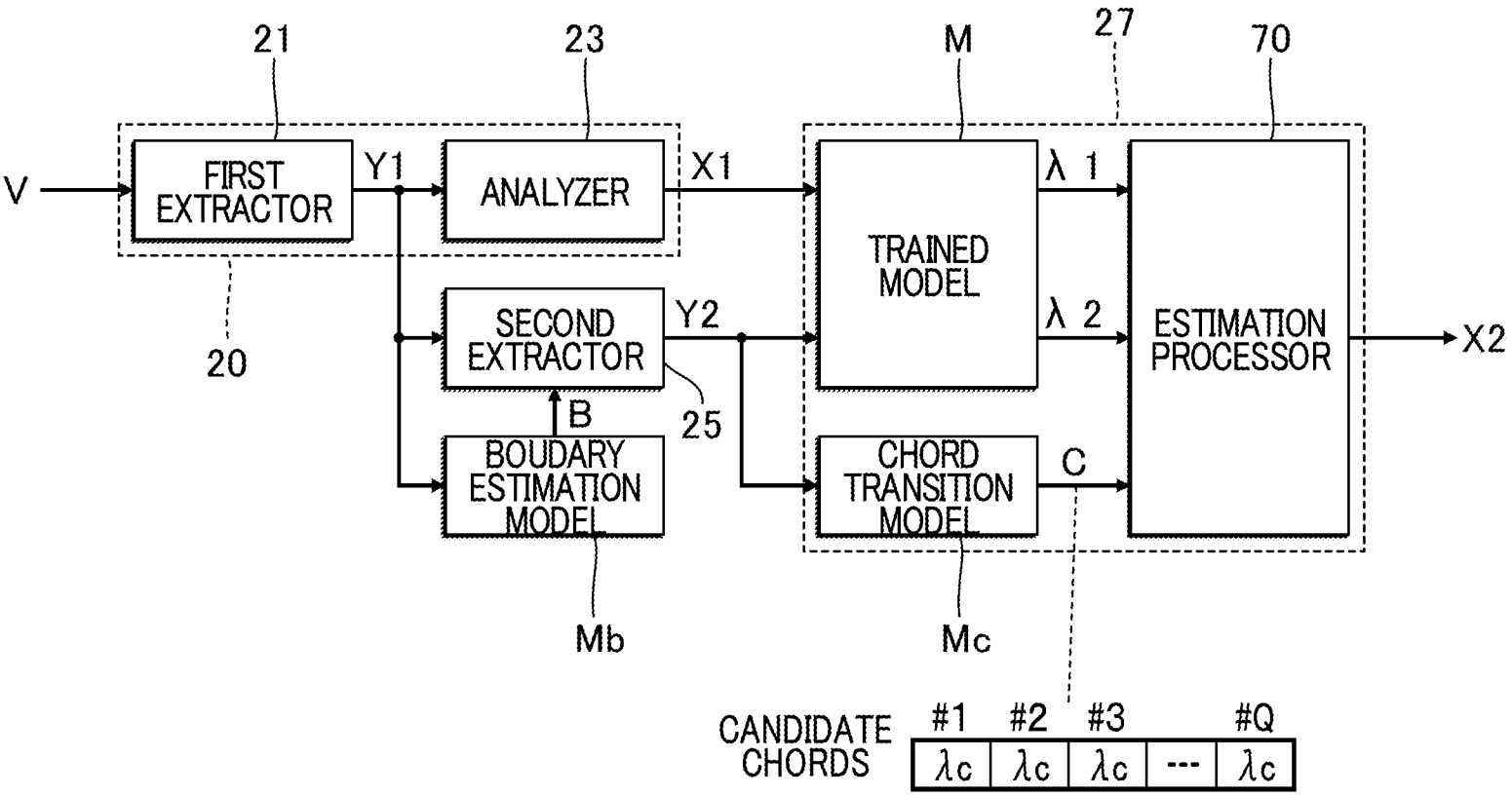
FIG. 15 is a block diagram illustrating a functional configuration of a chord estimation apparatus according to a sixth embodiment.

FIG. 15 is a block diagram illustrating a functional configuration of a controller 12 in a chord estimation apparatus 100 of a sixth embodiment. A chord estimator 27 of the sixth embodiment includes a chord transition model Mc in addition to components (a trained model M and an estimation processor 70) that are substantially the same as those in the first embodiment. A time series of second feature amounts Y2 output by the second extractor 25 is input to the chord transition model Mc. The chord transition model Mc is a trained model that has learned the chord transition tendency. The chord transition tendency is, for example, a progression of chords likely to frequently appear in existing pieces of music. Specifically, the chord transition model Mc is a trained model that has learned relationships between time series of second feature amounts Y2 and time series of pieces of chord data C, each representing a chord. That is, the chord transition model Mc outputs chord data C for each of continuous sections depending on the time series of the second feature amounts Y2. For example, a recurrent neural network (RNN) such as a long short term memory (LSTM) suitable for processing of the time series data is preferable for use as the chord transition model Mc.

The chord data C of the sixth embodiment represents an occurrence probability λc for each of the Q candidate chords. The occurrence probability λc corresponding to any one of the candidate chords means a probability (or likelihood) that a chord in a continuous section in the audio signal V corresponds to the candidate chord. The occurrence probability λc is set to have a numerical value within a range between 0 and 1 (inclusive). As will be understood from the above description, a time series of pieces of chord data C represents the chord transition. That is, the chord transition model Mc is a statistical estimation model that estimates the chord transition from a time series of second feature amounts Y2.

The estimation processor 70 of the sixth embodiment estimates second chords X2 based on an occurrence probability λ1 output by the first trained model M1, an occurrence probability λ2 output by the second trained model M2, and chord data C output by the chord transition model Mc. Specifically, the estimation processor 70 calculates the occurrence probability λ0 for each candidate chord by integrating the occurrence probability λ1, the occurrence probability λ2, and the occurrence probability λc of the chord data C for each of the candidate chords. The occurrence probability λ0 for each candidate chord is a weighted sum of the occurrence probability λ1, the occurrence probability λ2, and the occurrence probability λc, for example. The estimation processor 70 estimates a second chord λ2 for each unit period T, where a candidate chord having a high occurrence probability λ0 from among Q candidate chords is identified as the second chord X2. As will be understood from the above description, in the sixth embodiment, second chords X2 are estimated based on the output of the trained model M (i.e., the occurrence probability λ1 and the occurrence probability λ2) and the chord data C (the occurrence probability λc). Thus, second chords X2 are estimated by taking into account the chord transition tendencies learned by the chord transition model Mc, in addition to the above-described first tendency and second tendency.

The chord transition model Mc is realized by combination of a program that causes the controller 12 to execute a calculation that generates a time series of pieces of chord data C from a time series of second feature amounts Y2 (for example, a program module that constitutes a part of artificial intelligence software), and multiple coefficients Kc applied to the calculation. The coefficients Kc are set by machine learning (in particular, deep learning) using multiple pieces of training data Lc, and are stored in the storage device 13.

Figure 16:
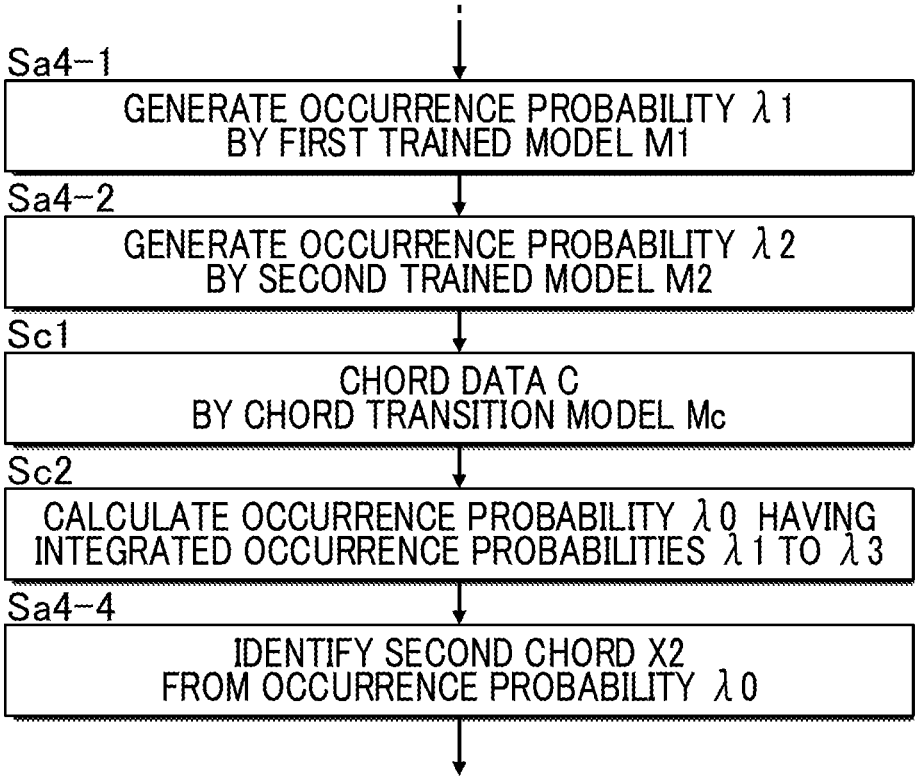
FIG. 16 is a flowchart illustrating a process of estimating second chords in the sixth embodiment.

FIG. 16 is a flowchart illustrating a specific procedure of a process in which the chord estimator 27 estimates second chords X2 (Sa4) in the sixth embodiment. In the sixth embodiment, the step Sa4-3 in the processing of the first embodiment described with reference to FIG. 7 is replaced by step Sc1 and step Sc2 of FIG. 16.

When an occurrence probability λ1 and an occurrence probability λ2 are generated for each of the candidate chords (Sa4-1, Sa4-2), the chord estimator 27 generates a time series of pieces of chord data C by inputting the time series of the second feature amounts Y2 extracted by the second extractor 25 to the chord transition model Mc (Sc1). The generation (Sa4-1) of the occurrence probability λ1, the generation (Sa4-2) of the occurrence probability λ2, and the generation (Sc1) of the chord data C may be performed in a freely selected order.

The chord estimator 27 calculates an occurrence probability λ0 for each candidate chord by integrating for each candidate chord the occurrence probability λ1, the occurrence probability λ2, and the occurrence probability λc represented by the chord data C (Sc2). The chord estimator 27 estimates a second chord X2, where the estimated second chord X2 corresponds to a candidate chord having a high occurrence probability λ0 from among Q candidate chords (Sa4-4). The specific procedure of a process for estimating second chords X2 in the sixth embodiment is as explained above.

Figure 17:
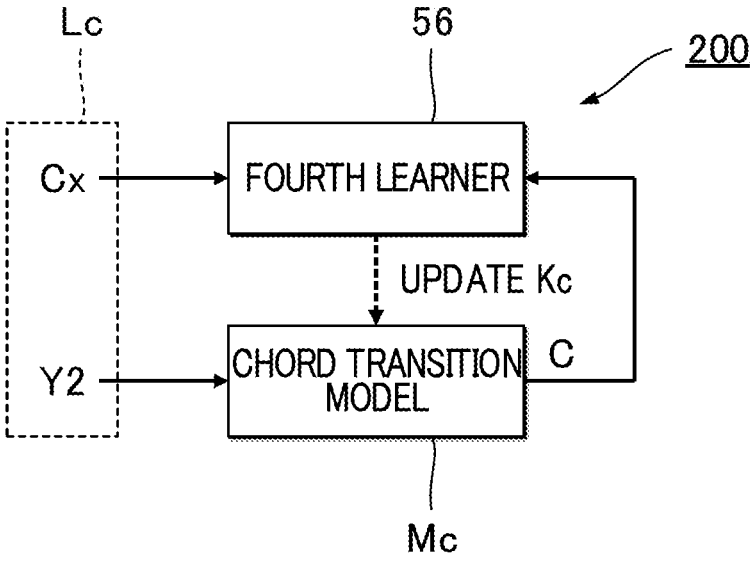
FIG. 17 is a diagram illustrating machine learning of a chord transition model in the sixth embodiment.

FIG. 17 is a block diagram illustrating a configuration of a machine learning apparatus 200 for setting multiple coefficients Kc of the chord transition model Mc. The machine learning apparatus 200 of the sixth embodiment includes a fourth learner 56. The fourth learner 56 sets coefficients Kc by machine learning using multiple pieces of training data Lc. Each piece of training data Lc includes a time series of second feature amounts Y2 and a time series of pieces of chord data Cx. Each piece of the chord data Cx consists of Q occurrence probabilities λc that each correspond to one of the respective candidate chords, and is generated based on the chord transition in known pieces of music. From among the Q occurrence probabilities λc of the chord data Cx, the occurrence probability λc corresponding to one candidate chord that actually appears in the known piece of music is set to have a numerical value 1, and the occurrence probabilities λc corresponding to the remaining (Q−1) candidate chords are set to have a numerical value 0.

The fourth learner 56 updates the coefficients Kc of the chord transition model Mc so as to reduce a difference between a provisional time series of pieces of chord data C that is output from the chord transition model Mc in response to input of the time series of the second feature amounts Y2 of the training data Lc, and the time series of pieces of the chord data Cx in the training data Lc. Specifically, the fourth learner 56 iteratively updates the coefficients Kc by, for example, back propagation to minimize an evaluation function representing a difference between the time series of the chord data C and the time series of the chord data Cx. The coefficients Kc set by the machine learning apparatus 200 in the above procedure are stored in the storage device 13 of the chord estimation apparatus 100. Accordingly, the chord estimation model Mc outputs a statistically valid time series of the chord data C with respect to an unknown time series of second feature amounts Y2 based on the tendency (i.e., the chord transition tendency appearing in the existing pieces of music) that is latent in the relationship between time series of second feature amounts Y2 and time series of pieces of chord data Cx in pieces of training data Lc. In one embodiment, the fourth learner 56 may be mounted to the chord estimation apparatus 100.

As described above, according to the sixth embodiment, second chords X2 concerning an unknown audio signal V are estimated using the chord transition model Mc that has learned relationships between time series of second feature amounts Y2 and time series of pieces of chord data C. Accordingly, as compared with the first embodiment in which the chord transition model Mc is not used, second chords X2 having an auditorily natural arrangement used for a large number of pieces of music can be estimated. It is of note that, in the sixth embodiment, the boundary estimation model Mb may be omitted.

Modifications

Specific modes of modification that are additional to the above-illustrated modes will be illustrated below. Two or more modes freely selected from the following examples may be appropriately combined unless they are contradictory to each other.

(1) In each of the above-described embodiments, the chord estimation apparatus 100 separate from the terminal apparatus 300 of the user U is used, but the chord estimation apparatus 100 may be mounted to the terminal apparatus 300. According to a configuration in which the terminal apparatus 300 and the chord estimation apparatus 100 form the same unit, an audio signal V need not be transmitted to the chord estimation apparatus 100 from the terminal apparatus 300. According to the configuration of each of the above-described embodiments, however, since the terminal apparatus 300 and the chord estimation apparatus 100 are separate apparatuses, a processing load on the terminal apparatus 300 is reduced. Alternatively, the components (for example, the first extractor 21, the analyzer 23, and the second extractor 25) that extract a feature amount of an audio signal V may be mounted to the terminal apparatus 300. In this case, the terminal apparatus 300 transmits the feature amount of the audio signal V to the chord estimation apparatus 100, and the chord estimation apparatus 100 transmits, to the terminal apparatus 300, a second chord X2 estimated from the feature amount transmitted from the terminal apparatus 300.

(2) In each of the above-described embodiments, the trained model M includes the first trained model M1 and the second trained model M2, but a mode of the trained model M is not limited to the above-described examples. For example, a statistical estimation model that has learned the first tendency and the second tendency using N pieces of training data L may be used as the trained model M. Such a trained model M may output an occurrence probability for each chord based on the first tendency and the second tendency. The process of calculating the occurrence probability λ0 in the estimation processor 70 may thus be omitted.

(3) In each of the above-described embodiments, the second trained model M2 learns the second tendency, but the second tendency that the second trained model M2 learns is not limited to the above-described examples. For example, the second trained model M2 may learn only a tendency of whether or not chords are modified. Thus, the first tendency need not constitute a part of the second tendency.

(4) In each of the above-described embodiments, the trained model (M1, M2) outputs the occurrence probability (λ1, λ2) for each chord, but the data output by the trained model M is not limited to the occurrence probability (λ1, λ2). For example, the first trained model M1 and the second trained model M2 may output the chords themselves.

(5) In each of the above-described embodiments, a single second chord X2 corresponding to a first chord X1 is estimated, but multiple second chords X2 corresponding to the first chord X1 may be estimated. Two or more chords having highest order occurrence probabilities λ0 from among the occurrence probabilities λ0 for the respective chords calculated by the estimation processor 70 may be transmitted to the terminal apparatus 300 as the second chords X2. The user U then identifies a desired chord from among the second chords X2 transmitted.

(6) In each of the above-described embodiments, a feature amount corresponding to a unit period T is input to the trained model M. However, the feature amounts for unit periods before and after the unit period T may be input to the trained model M together with the feature amount corresponding to the unit period T.

(7) In each of the above-described embodiments, the first feature amount Y1 includes a Chroma vector including multiple component intensities Pq that correspond one-to-one to multiple pitch classes, and an intensity Pv of the audio signal V. However, the contents of the first feature amount Y1 are not limited to the above-described examples. For example, only the Chroma vector may be used as the first feature amount Y1. Also, variances σq and averages μq may be used as a second feature amount Y2, where a variance σq and an average μq for each time series of component intensities Pq for each pitch class are represented by a Chroma vector. The first feature amount Y1 and the second feature amount Y2 may be any feature amount if a difference in chord is reflected.

(8) In each of the above-described embodiments, the chord estimation apparatus 100 estimates second chords X2 by the trained model M from a feature amount of the audio signal V. However, a method of estimating the second chords X2 is not limited to the above-described examples. For example, from among second feature amounts Y2 with each of which one of different chords is associated, a chord associated with a second feature amount Y2 that is most similar to the second feature amount Y2 extracted by the second extractor 25 may be estimated as a second chord X2.

(9) In the above-described fifth embodiment, the boundary data B represents, in binary form, whether each unit period T corresponds to a boundary between continuous sections. However, the contents of the boundary data B are not limited to the above-described examples. For example, the boundary estimation model Mb may output the boundary data B that represents a likelihood that each unit period T is a boundary between continuous sections. Specifically, each data segment b of the boundary data B is set to have a numerical value within a range between 0 to 1 (inclusive) and the total of the numerical values represented by the multiple data segments b will be a predetermined value (for example, 1). The second extractor 25 estimates the boundary between continuous sections based on the likelihood represented by each data segment b of the boundary data B, and extracts the second feature amount Y2 for each of the continuous sections.

(10) In the above-described sixth embodiment, the chord transition model Mc is a trained model that has learned relationships between time series of second feature amounts Y2 and time series of pieces of chord data C, but feature amounts to be input to the chord transition model Mc are not limited to the second feature amounts Y2. For example, in a configuration where the chord transition model Mc has learned relationships between time series of first feature amounts Y1 and time series of pieces of chord data C, a time series of first feature amounts Y1 extracted by the first extractor 21 is input to the chord transition model Mc. The chord transition model Mc outputs a time series of pieces of chord data C depending on the time series of the first feature amounts Y1. The chord transition model Mc that has learned relationships between time series of pieces of chord data C and time series of feature amounts that are different in type from the first feature amount Y1 and from the second feature amount Y2 may be used for estimation of a time series of pieces of chord data C.

(11) In the above-described sixth embodiment, the chord data C represents, for each of Q candidate chords, an occurrence probability λc for which the numerical value is within a range between 0 and 1 (inclusive) but the specific contents of the chord data C are not limited to the above-described examples. For example, the chord transition model Mc may output chord data C in which the occurrence probability λc of any one of the Q candidate chords is set as a numerical value 1, and the occurrence probabilities λc of the rest (Q−1) of candidate chords is set as the numerical value 0. That is, the chord data C is a Q-dimensional vector with any one of Q candidate chords being represented by one-hot encoding.

(12) In the sixth embodiment, the chord estimation apparatus 100 includes the trained model M, the boundary estimation model Mb, and the chord transition model Mc, but the chord estimation apparatus 100 may use the boundary estimation model Mb alone, or the chord transition model Mc alone. In one example, the trained model M and the chord transition model Mc are not necessary in an information processing apparatus (boundary estimation apparatus) that uses the boundary estimation model Mb to estimate boundaries between continuous sections from a time series of first feature amounts Y2. In another example, the trained model M and the boundary estimation model Mb are not necessary in an information processing apparatus (chord transition estimation apparatus) that uses the chord transition model Mc to estimate chord data C from a time series of second feature amounts. In still another example, the trained model M may be omitted in an information processing apparatus that includes the boundary estimation model Mb and the chord transition model Mc. Thus, the occurrence probability λ1 and the occurrence probability λ2 need not be generated. From among Q candidate chords, a candidate chord whose occurrence probability λc is high is output for each unit period T as a second chord X2, where the occurrence probability λc is output from the chord transition model Mc.

(13) The chord identification apparatus 100 and the machine learning apparatus 200 according to the above-described embodiment and modifications are realized by a computer (specifically, a controller) and a program working in coordination with each other, as illustrated in the embodiment and modifications. A program according to the above-described embodiment and modifications may be provided in the form of being stored in a computer-readable recording medium, and installed on a computer. The recording medium is, for example, a non-transitory recording medium, and is preferably an optical recording medium (optical disc) such as CD-ROM or the like. However, the recording medium may include any type of a known recording medium such as a semiconductor recording medium, a magnetic recording medium, or the like. The non-transitory recording medium may be a freely-selected recording medium other than the transitory propagating signal, and does not exclude a volatile recording medium. Also, the program can be provided in a form that is distributable via a communication network. An element for executing the program is not limited to a CPU, and may instead be a processor for a neural network such as a tensor processing unit or a neural engine, or a DSP (Digital Signal Processor) for signal processing. The program may be executed by multiple elements working in coordination with each other, where the elements are selected from among those described in the above embodiments.

(14) The trained model (the first trained model M1, the second trained model M2, the boundary estimation model Mb, or the chord transition model Mc) is a statistical estimation model (for example, a neural network) that is implemented by the controller (one example of a computer), and generates an output B for an input A. Specifically, the trained model is implemented by a combination of a program (for example, a program module constituting a part of artificial intelligence software) that causes the controller to execute the calculation identifying the output B from the input A, and coefficients applied to the calculation. The coefficients of the trained model are optimized by the pre-machine learning (deep learning) using multiple pieces of training data that associate the input A with the output B. That is, the trained model M is a statistical estimation model that has learned relationships between inputs A and outputs B. The controller generates a statistically valid output B relative to the input A based on the potential tendency of the multiple pieces of training data (the relationship between the input A and the output B) by executing, on an unknown input A, the calculation to which the learned coefficients and a predetermined response function are applied.

(15) The following modes are derivable from the above-described embodiments and modifications.

A chord estimation method according to a preferred mode (first aspect) is a method of estimating a first chord from an audio signal; and estimating a second chord by inputting the first chord to a trained model that has learned a chord modification tendency. According to the above-described aspect, a second chord is estimated by inputting a first chord estimated from an audio signal to the trained model that has learned the chord modification tendency, and therefore, the second chord for which the chord modification tendency is taken into account can be estimated with a higher degree of accuracy as compared with a configuration in which only the first chord is estimated from the audio signal.

In a preferred example (second aspect) of the first aspect, the trained model includes a first trained model that has learned a tendency as to how chords are modified, and a second trained model that has learned a tendency as to whether the chords are modified; and the second chord is estimated depending on an output obtained when the first chord is input to the first trained model and an output obtained when the first chord is input to the second trained model. According to the above-described aspect, a second chord in which the chord modification tendency is appropriately reflected can be better estimated as compared with the method of estimating the second chord using only one or other of the first trained model or the second trained model, for example.

In a preferred example (third aspect) of the first aspect, estimating the first chord includes estimating a first chord from a first feature amount including, for each of pitch classes, a component intensity depending on an intensity of a component corresponding to each pitch class in the audio signal; and estimating the second chord includes estimating a second chord by inputting, to the trained model, a second feature amount including an index relating to temporal changes in the component intensity for each class and by also inputting the first chord to the trained model. According to the above-described aspect, a second chord is estimated by inputting, to a trained model, a second feature amount including an index relating to temporal changes in the component intensity (a variance and an average for a time series of component intensities) of each of the pitch classes, and therefore, the second chord can be estimated with a high degree of accuracy by taking into account temporal changes in the audio signal.

In a preferred example (fourth aspect) of the third aspect, the first feature amount includes an intensity of the audio signal, and the second feature amount includes an index relating to temporal changes in the intensity of the audio signal. According to the above-described aspect, the effect that the second chord can be estimated with a high degree of accuracy by taking into account temporal changes in the audio signal is particularly significant.

In a preferred example (fifth aspect) of the first aspect, the method further includes estimating boundary data representative of a boundary between continuous sections during each of which a chord is continued, by inputting a time series of first feature amounts of the audio signal to a boundary estimation model that has learned relationships between time series of first feature amounts and pieces of boundary data; and extracting a second feature amount from the time series of the first feature amounts of the audio signal for each of continuous sections represented by the estimated boundary data, and estimating the second chord includes estimating a second chord by inputting the first chord and the second feature amount to the trained model. According to the above-described aspect, the boundary data concerning an unknown audio signal is generated using the boundary estimation model that has learned relationships between time series of first feature amounts and pieces of boundary data. Accordingly, a second chord can be estimated with a high degree of accuracy by using a second feature amount generated based on the boundary data.

In a preferred example (sixth aspect) of the first aspect, the method further includes estimating a time series of pieces of chord data, each piece representing a chord, by inputting a time series of feature amounts of the audio signal to a chord transition model that has learned relationships between a time series of feature amounts and a time series of pieces of the chord data, and estimating the second chord includes estimating a second chord based on an output of the trained model and the estimated time series of chord data. According to the above-described aspect, the second chord concerning an unknown audio signal is estimated using the chord transition model that has learned relationships between time series of feature amounts and time series of pieces of chord data. Accordingly, an auditorily natural arrangement of the second chords observed in multiple pieces of music can be estimated as compared with a configuration in which the chord transition model is not used.

In a preferred example (seventh aspect) of the first to sixth modes, the method further includes receiving the audio signal from a terminal apparatus; estimating the second chord by inputting to the trained model the first chord estimated from the audio signal; and transmitting the estimated second chord to the terminal apparatus. According to the above-described aspect, the processing load on the terminal apparatus is reduced as compared with a method of estimating a chord by the trained model mounted to the terminal apparatus of a user, for example.

A preferred aspect of the present disclosure is achieved even in a chord estimation apparatus that implements a chord estimation method of each aspect described above or a program causing a computer to execute the chord estimation method of each aspect described above. For example, a chord estimation apparatus in one aspect includes a processor configured to execute stored instructions to estimate a first chord from an audio signal, and estimate a second chord by inputting the first chord to a trained model that has learned a chord modification tendency.

DESCRIPTION OF REFERENCE SIGNS

100 . . . chord estimation apparatus, 200 . . . machine learning apparatus, 300 . . . terminal apparatus, 11 . . . communication device, 12 . . . controller, 13 . . . storage device, 20 . . . pre-processor, 21 . . . first extractor, 23 . . . analyzer, 25 . . . second extractor, 27 . . . chord estimator, 51 . . . training data generator, 512 . . . selector, 514 . . . generation processor, 53 . . . learner, 532 . . . first learner, 534 . . . second learner, 55 . . . third learner, 56 . . . fourth learner, 70 . . . estimation processor, M . . . trained model, M1 . . . first trained model, M2 . . . second trained model, Mb . . . boundary estimation model, Mc . . . chord transition model

What is claimed is:

1. A computer-implemented chord estimation method comprising:

estimating a first chord from an audio signal; and estimating a second chord by inputting the first chord to a trained model that has learned a chord modification tendency made to first chords by users.

2. The chord estimation method according to claim 1, wherein the trained model includes a first trained model that has learned a tendency as to how the first chords are modified by the users, and a second trained model that has learned a tendency as to whether the first chords are modified by the users, and the second chord is estimated depending on an output obtained when the first chord is input to the first trained model and an output obtained when the first chord is input to the second trained model.

3. The chord estimation method according to claim 1, wherein estimating the first chord includes estimating a first chord from a first feature amount including, for each of pitch classes, a component intensity depending on an intensity of a component corresponding to each pitch class in the audio signal; and estimating the second chord includes estimating a second chord by inputting, to the trained model, a second feature amount including an index relating to temporal changes in the component intensity for each class and by also inputting the first chord to the trained model.

4. The chord estimation method according to claim 3, wherein the first feature amount includes an intensity of the audio signal, and the second feature amount includes an index relating to temporal changes in the intensity of the audio signal.

5. The chord estimation method according to claim 1, further comprising:

estimating boundary data representative of a boundary between continuous sections during each of which a chord is continued, by inputting a time series of first feature amounts of the audio signal to a boundary estimation model that has learned relationships between a time series of first feature amounts and pieces of the boundary data; and extracting a second feature amount from the time series of the first feature amounts of the audio signal for each of continuous sections represented by the estimated boundary data, wherein estimating the second chord includes estimating a second chord by inputting the first chord and the second feature amount to the trained model.

6. The chord estimation method according to claim 1, further comprising;

estimating a time series of pieces of chord data, where each piece of chord data represents a chord, by inputting a time series of feature amounts of the audio signal to a chord transition model that has learned relationships between time series of feature amounts and time series of pieces of chord data, wherein estimating the second chord includes estimating a second chord based on an output of the trained model and the estimated time series of chord data.

7. The chord estimation method according to claim 1, further comprising:

receiving the audio signal from a terminal apparatus;

estimating the second chord by inputting to the trained model the first chord estimated from the audio signal; and transmitting the estimated second chord to the terminal apparatus.

8. A chord estimation apparatus comprising:

a processor configured to execute stored instructions to:

estimate a first chord from an audio signal; and estimate a second chord by inputting the first chord to a trained model that has learned a chord modification tendency made to first chords by users.

9. The chord estimation apparatus according to claim 8, wherein the trained model includes a first trained model that has learned a tendency as to how the first chords are modified by the users, and a second trained model that has learned a tendency as to whether the first chords are modified by the users, and the processor is configured to, in estimating the second chord, estimate a second chord in accordance with an output obtained when the first chord is input to the first trained model, and an output obtained when the first chord is input to the second trained model.

10. The chord estimation apparatus according to claim 8, wherein the processor is configured to:

in estimating the first chord, estimate a first chord from a first feature amount including, for each of pitch classes, a component intensity depending on an intensity of a component corresponding to each pitch class in the audio signal; and in estimating the second chord, estimate a second chord by inputting, to the trained model, a second feature amount including an index relating to temporal changes in the component intensity for each class and also inputting the first chord.

11. The chord estimation apparatus according to claim 10, wherein the first feature amount includes an intensity of the audio signal, and the second feature amount includes an index relating to temporal changes in the intensity of the audio signal.

12. The chord estimation apparatus according to claim 8, wherein the processor is further configured to:

execute a boundary estimation model that has learned relationships between time series of first feature amounts and pieces of boundary data, each piece of boundary data representing a boundary between continuous sections during each of which a chord is continued, where the boundary estimation model outputs boundary data in response to an input of a time series of first feature amounts of the audio signal; and extract a second feature amount from the time series of the first feature amounts of the audio signal for each of the continuous sections represented by the boundary data output by the boundary estimation model, and wherein the processor is configured to, in estimating the second chord, estimate a second chord by inputting the first chord and the second feature amount to the trained model.

13. The chord estimation apparatus according to claim 8, wherein the processor is further configured to:

execute a chord transition model that has learned relationships between time series of feature amounts and time series of pieces of chord data, each piece of chord data representing a chord, where the chord transition model outputs a time series of pieces of chord data in response to an input of a time series of a feature amounts of the audio signal, and wherein the processor is configured to, in estimating the second chord, estimate a second chord based on an output from the trained model and the output time series of pieces of chord data.

14. The chord estimation apparatus according to claim 8, wherein the processor is further configured to:

receive the audio signal from a terminal apparatus;

estimate the second chord by inputting to the trained model the first chord estimated from the audio signal; and transmit the estimated second chord to the terminal apparatus.

15. A computer-implemented chord estimation method comprising:

estimating a first chord from an audio signal; and estimating a second chord by inputting the first chord to a trained model that has learned a chord modification tendency;

wherein the trained model includes a first trained model that has learned a tendency as to how chords are modified, and a second trained model that has learned a tendency as to whether the chords are modified, and the second chord is estimated depending on an output obtained when the first chord is input to the first trained model and an output obtained when the first chord is input to the second trained model.

16. A chord estimation apparatus comprising:

a processor configured to execute stored instructions to:

estimate a first chord from an audio signal; and estimate a second chord by inputting the first chord to a trained model that has learned a chord modification tendency; wherein the trained model includes a first trained model that has learned a tendency as to how chords are modified, and a second trained model that has learned a tendency as to whether the chords are modified; and the processor is configured to, in estimating the second chord, estimate a second chord in accordance with an output obtained when the first chord is input to the first trained model, and an output obtained when the first chord is input to the second trained model.

* * * * *